US005329501A

United States Patent [19]

Meister et al.

[11] Patent Number: 5,329,501

[45] Date of Patent: Jul. 12, 1994

[54] TIMEPIECE ADAPTED TO RECEIVE RADIO BROADCAST MESSAGES TO BE DISPLAYED BY ITS HANDS

[75] Inventors: Pierre-André Meister, Bienne; Andreas Tschanz, Würenlos, both of Switzerland

[73] Assignee: Eta SA Fabriques d'Ebauches, Grenchen, Switzerland

[21] Appl. No.: 130,259

[22] Filed: Oct. 1, 1993

[30] Foreign Application Priority Data

Oct. 8, 1992 [CH] Switzerland ..... 03 144/92-5

[51] Int. Cl.[5] ..... G04B 47/00; G08B 5/22

[52] U.S. Cl. ..... 368/10; 368/47; 368/55

[58] Field of Search ..... 368/41, 44, 10; 340/825.44, 825.45, 825.46, 825.48, 825.49

[56] References Cited

U.S. PATENT DOCUMENTS

| | | | |
|---|---|---|---|
| 4,398,831 | 8/1983 | Fatton et al. | 368/76 |
| 4,620,797 | 11/1986 | Besson et al. | 368/21 |
| 4,884,252 | 11/1989 | Teodoridis et al. | 368/10 |
| 4,969,133 | 11/1990 | Triponez | 368/80 |
| 5,061,921 | 10/1991 | Lesko et al. | 340/815.24 |
| 5,159,331 | 10/1992 | Park et al. | 368/10 |
| 5,266,945 | 11/1993 | Peek et al. | 368/10 |
| 5,268,880 | 12/1993 | Meister et al. | 368/10 |

FOREIGN PATENT DOCUMENTS

| | | |
|---|---|---|
| 0364602 | 4/1990 | European Pat. Off. . |
| 0460525 | 5/1991 | European Pat. Off. . |
| 0460526 | 5/1991 | European Pat. Off. . |
| 0476425 | 9/1991 | European Pat. Off. . |
| 8805184 | 7/1988 | PCT Int'l Appl. . |
| 607669 | 10/1978 | Switzerland . |

OTHER PUBLICATIONS

Motorola Technical Developments vol. 12, Apr. 1991, Schaumburg US pp. 126-128, XP000229300 W. J. Kuznicki and Al. Implementation of a flexible "clasp-/watchband" pager' figure *3.

*Primary Examiner*—Bernard Roskoski

*Attorney, Agent, or Firm*—Griffin Butler Whisenhunt & Kurtossy

[57] ABSTRACT

The timepiece includes a time keeper in order to display hours and minutes by means of hands (4, 5) surmounting a dial (80) surrounded by a bezel (7) and a receiver capable of receiving messages for seeking persons issuing from at least two calling numbers. The calling numbers (81) are inscribed in plain language or in a coded form on the bezel and means are activated in order that, upon reception of a message, such is stored and the hands (4,5) cease their time-indicating function in order to come into position to show the calling number which emits the message by superposing themselves (4', 5') thereover.

20 Claims, 13 Drawing Sheets

TIMEPIECE ADAPTED TO RECEIVE RADIO BROADCAST MESSAGES TO BE DISPLAYED BY ITS HANDS

The present invention is relative to a timepiece including a timekeeper in order to display at least hours and minutes by means of hands surmounting a dial surrounded by a bezel, a receiver capable of receiving radio broadcast messages for seeking persons, reception being triggered by the composition on a telephone handset of at least two predetermined and distinctive calling numbers, a memory for storing said calls, an acoustic transducer for signalling at least the arrival of a message and a control arrangement including at least one stem fitted with a crown capable of being manually actuated.

BACKGROUND OF THE INVENTION

A timepiece responding to the generic definition hereinabove has already been described in several documents published in the name of the same assignee. The general arrangement of the antenna confined in a watch case forms the object of patent document EP-B-0 339 482 (US-A-4 884 252). The assembly of movement, caseband and back cover of such a timepiece is described in the document EP-A-0 460 526. Finally, the arrangement of the power cell energizing the radio-frequency portion of the watch is set forth in patent document EP-A-0 460 525.

More precisely, a timepiece responding also to the generic definition hereinabove has been placed on the market on the 2nd of Dec. 1991 by the assignee of the present invention and bears the name "Swatch pager tone only" the instructions for use of which will now be reviewed with the help of FIGS. 1 and 2 accompanying this description.

FIG. 1 is a plan view of the timepiece in question. Such timepiece includes a timekeeper which displays the time of day by means of hours and minutes hands 4 and 5. It further includes a pager system, that is to say, an arrangement comprising a radio-broadcast message receiver and a memory for storing such messages. The messages are captured by an antenna appearing in the form of wires 6, such antenna being wound around the baseplate of the case. The timepiece is controlled by a control arrangement 3 which includes on the one hand a crown 10 fitted onto a stem, not shown, and on the other hand by two push-pieces 1 and 2. The crown may assume three different axial positions. The first push-piece 1 located at 8 o'clock enables turning on (ON) or turning off (OFF) the pager. The second push-piece 2, located at 10 o'clock, enables placing the pager into a standby state (SIL=silence) for which received messages are at least stored in the memory without being signalled by an acoustic diffuser 8 for which only the orifice has been shown on FIG. 1.

The pager is a personalized wrist-watch fitted out with an integrated radio receiver capable of receiving radio-broadcast messages for seeking .persons, as already said hereinabove. In Switzerland, messages are transmitted over the local calling network B of the Post Office Telephone and Telegraph company. Four calling numbers correspond to each pager here examined.

In order to turn on or turn off the pager, pressure is exerted on the first push-piece 1. A long bip confirms the placing into service and interruption of the pager. In pressing on crown 10, a short bip will be heard if the pager is turned on, two short bips if it is out of service. In the out-of-service mode, the pager consumes little energy but on the other hand receives no messages.

Messages can only be received if the pager is turned on (mode ON). Calls trigger the following acoustic alarms during about sixteen seconds, such alarms being shown on FIG. 2, letters E, F, G and H.

First calling number: one bip (long) each second, FIG. 2, letter E;

Second calling number: two bips (one short and one long) each second, FIG. 2, letter F;

Third calling number: three bips (short) each second, FIG. 2, letter G, and

Fourth calling number: four bips (short) each second, FIG. 2, letter H.

To interrupt the alarm, it is sufficient to press on crown 10. The message is not memorized.

The pager, however, memorizes automatically the messages which enter and which are not interrupted by pressing on crown 10. Such messages can be reconstituted at any instant by a simple pressure on crown 10 and this in the order of the calling numbers. It will be noted that the messages are first of all announced, then deleted from the memory as soon as the pager is placed out of service (mode OFF).

Reception of messages is possible without ringing the acoustic alarms. For this, the second push-piece 2 is pressed, which places the pager in the standby or silent mode (SIL). Such change of mode is also confirmed by a long bip. Such function can only be actuated if the pager is turned on (mode ON). In order to have the silent mode confirmed, it is sufficient to press on crown 10 which will have as effect the emission of three short bips. From then on, the messages are memorized without the alarm sounding.

In order to terminate inhibition of the acoustic alarm and return thus to the normal alarm mode (mode ON), pressure once again will be exerted on the second push-piece 2 (SIL). A long bip confirms return to the mode ON and the messages, if there are any, will be reconstituted in the order of the calling numbers.

From the description Which has just been given hereinabove, it will be understood that different sonic codes are called for, depending on the calling numbers (see FIG. 2). Also, different sonic codes are called for (one, two or three short bips) for checking the mode in which the pager happens to be (respectively ON, OFF or SIL). It will be understood that such situation can create confusion if the wearer of the pager is not attentive or if his ear has not been accustomed to memorize the codes as received.

SUMMARY OF THE INVENTION

In order to overcome these drawbacks, the timepiece of the present invention is characterized by the fact that at least the calling numbers are inscribed on the dial or the bezel in plain language or coded form, and that means are actuated so that at least upon reception of a message, such is stored in the memory and that at least one hand ceases its time indicating function in order to come to show the calling number emitting said message.

The invention will now be explained by means of the accompanying drawings.

BRIEF DESCRIPTION OF THE DRAWINGS

FIG. 15 is a diagram explaining how a message is received in the pager watch of FIG. 3 when the receiver is turned on;

DESCRIPTION OF THE PREFERRED EMBODIMENTS

Figure 1:
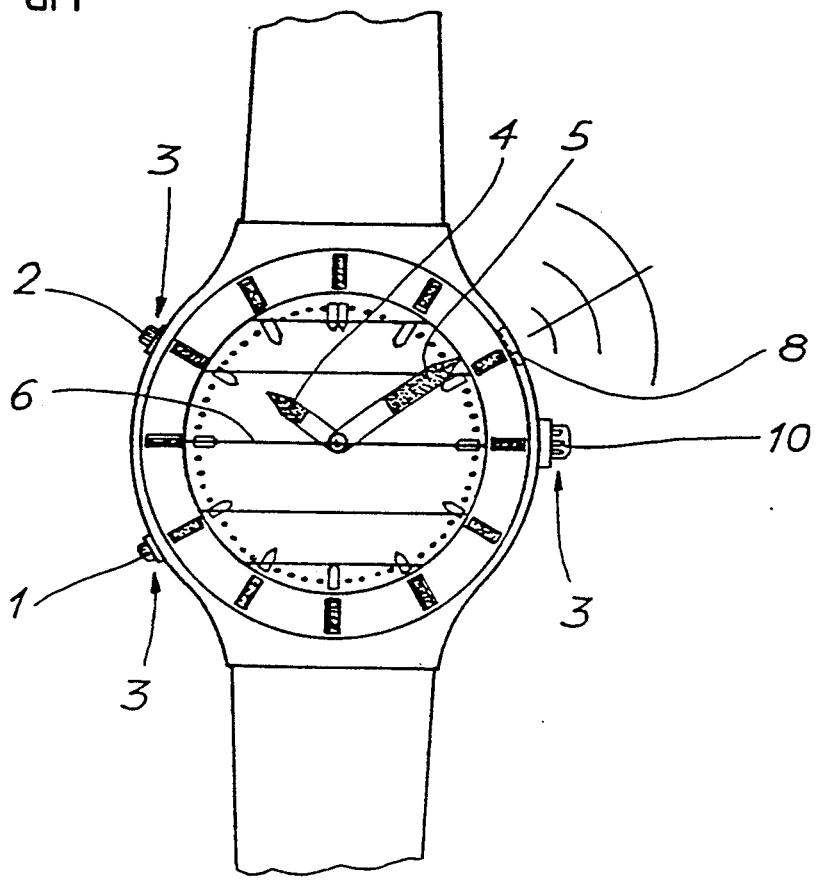
Fig.1 Prior art
FIG. 1 is a plan view of a pager watch executed according to the prior art.
Figure 2:
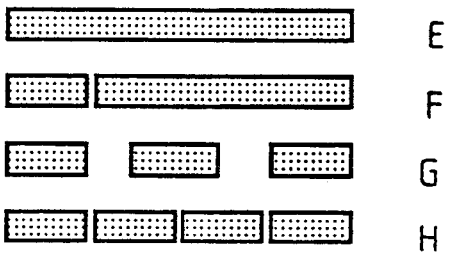
Fig.2 Prior art
FIG. 2 is an illustration of the sonic alarms given out by the pager watch of FIG. 1.
Figure 3:
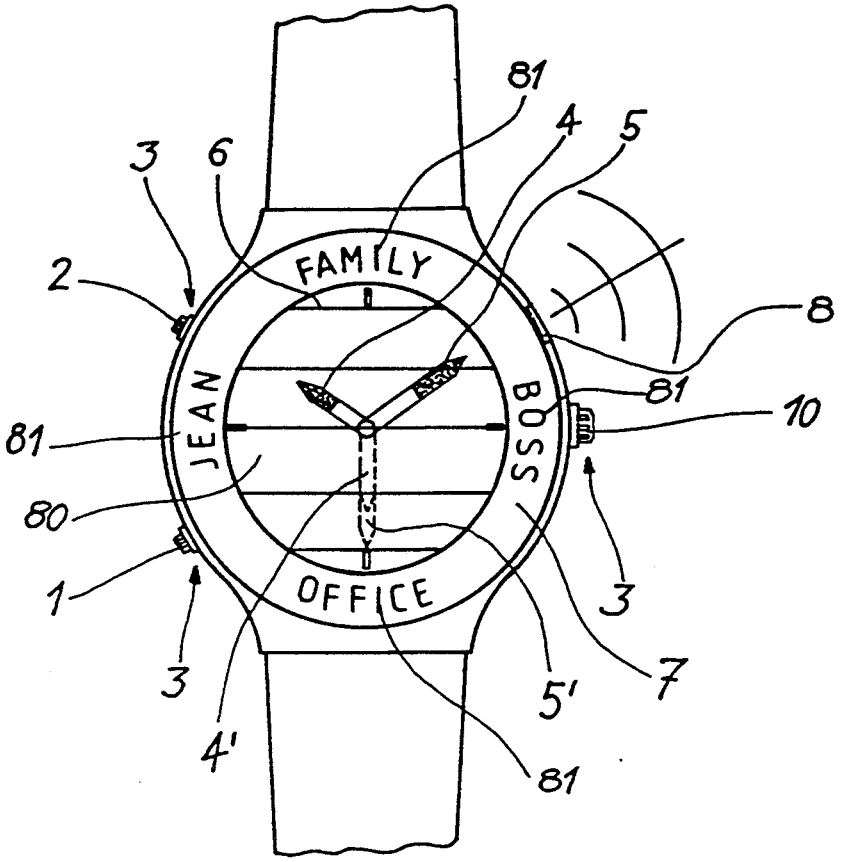
FIG. 3 is a plan view of the pager watch made according to a first embodiment of this invention.

The timepiece shown in plan view on FIG. 3 resembles very closely that described above concerning FIG. 1.

Here there is once again found a control arrangement 3 including a crown 10 and two push-pieces 1 and 2. The watch comprises a timekeeper enabling display of hours by means of hand 4 and minutes by hand 5. Such watch further includes a receiver capable of receiving radio broadcast messages for seeking persons, such messages being received by antenna 6. At least two messages can be received by the pager, the example illustrated noting four thereof. The messages can be stored in a memory. Such receiver and memory will form the object of a description to be found further on. To attain the person who wears the watch, the caller composes on his telephone handset a predetermined calling number. According to the prior art recalled hereinabove, the watch wearer can identify the caller by the particular sound which is attributed thereto (for example three bips in one second, such signal being repeated during about sixteen seconds). The sound is diffused by an acoustic transducer. According to the present invention, such acoustic transducer will not be employed to identify the caller, but at least to signal that a message has arrived.

According to the basic characteristic of the invention, the calling numbers are inscribed on the dial 80 or bezel 7 of the timepiece, means being placed into operation in order that upon reception of a message, such is placed in the memory and that at least one hand, for example the minutes hand, ceases its time indicating function at 5 in order to come to show at 5' the calling number 81 which is emitting the message.

FIG. 3 shows calling numbers affixed onto bezel 7, such numbers appearing in a coded form. Such figure also shows that it is both the hours 4 and minutes 5 hands which cease their function of indicating hours and minutes in order to come to show in superposing themselves at 4' and 5' over the calling number 81 "office" which emits the message. The superposition of the hands requires, as will be described subsequently, two motors, each driving a hand. The coded calling numbers 81 shown on FIG. 3 evidently correspond to real numbers which Jean, the family, the boss or the office must compose in order to attain the wearer of the pager watch. Thus, to summarize, an entering message causes sounding of an alarm which incites the wearer to look at his watch. If the hands 4 and 5 point onto the indication "office", the wearer is requested to call back his office.

Figure 4:
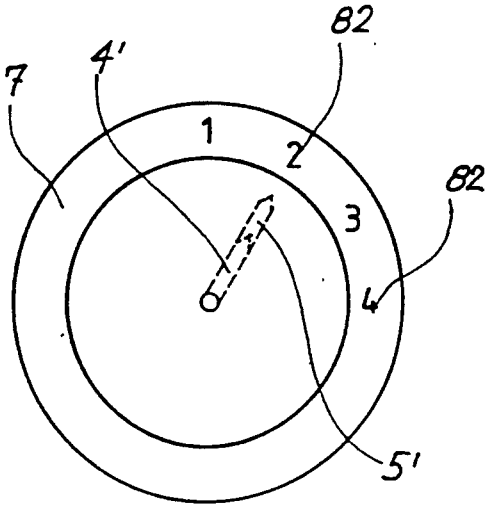
FIGS. 4 and 5 show different executions of bezels applicable to the pager watch of FIG. 3.
Figure 5:
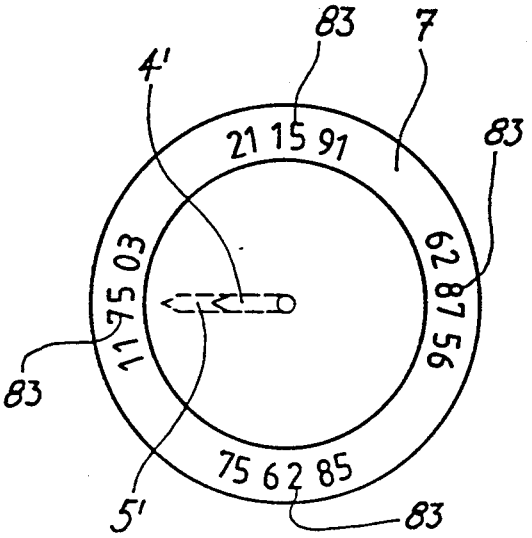

In the place of coded calling numbers shown on FIG. 3, the numbers can be inscribed in plain language, that is to say, the numbers which Jean, the family, the boss or the office must compose in order to attain the wearer of the watch. Such coded calling numbers shown on FIG. 3 could be replaced by the numbers in digits as shown on FIG. 5, reference 83, such digits indicating most usefully moreover, which telephone numbers the wearer of the watch must compose if he wishes to attain Jean, the family, the boss or the office. FIG. 4 further shows another manner of presenting the calls received by a simple serial number 82 and not necessarily arranged in quadrature as is the case in FIGS. 3 and 4.

In order to render the invention more universal, it is useful to propose a pager watch with a movable bezel 7 which is readily interchangeable, if not by the watch wearer, at least by the manufacturer. Thus, at the moment of ordering the watch from a retailer, the purchaser can make known the indications which he wishes to see placed on the bezel, such indications to be executed by the manufacturer and which will give the watch a personalized aspect.

What has just been said hereinabove is valid for both embodiments of the invention suggested in this document, that is to say, for a watch executed according to FIG. 3 or according to FIG. 17. Such two embodiments also employ in common a control arrangement including at least one stem fitted with a crown capable of being manually actuated. There will now be described this control mechanism in which the stem can be brought into at least three different axial positions. For this description reference will be had to FIGS. 6 to 12.

Figure 6:
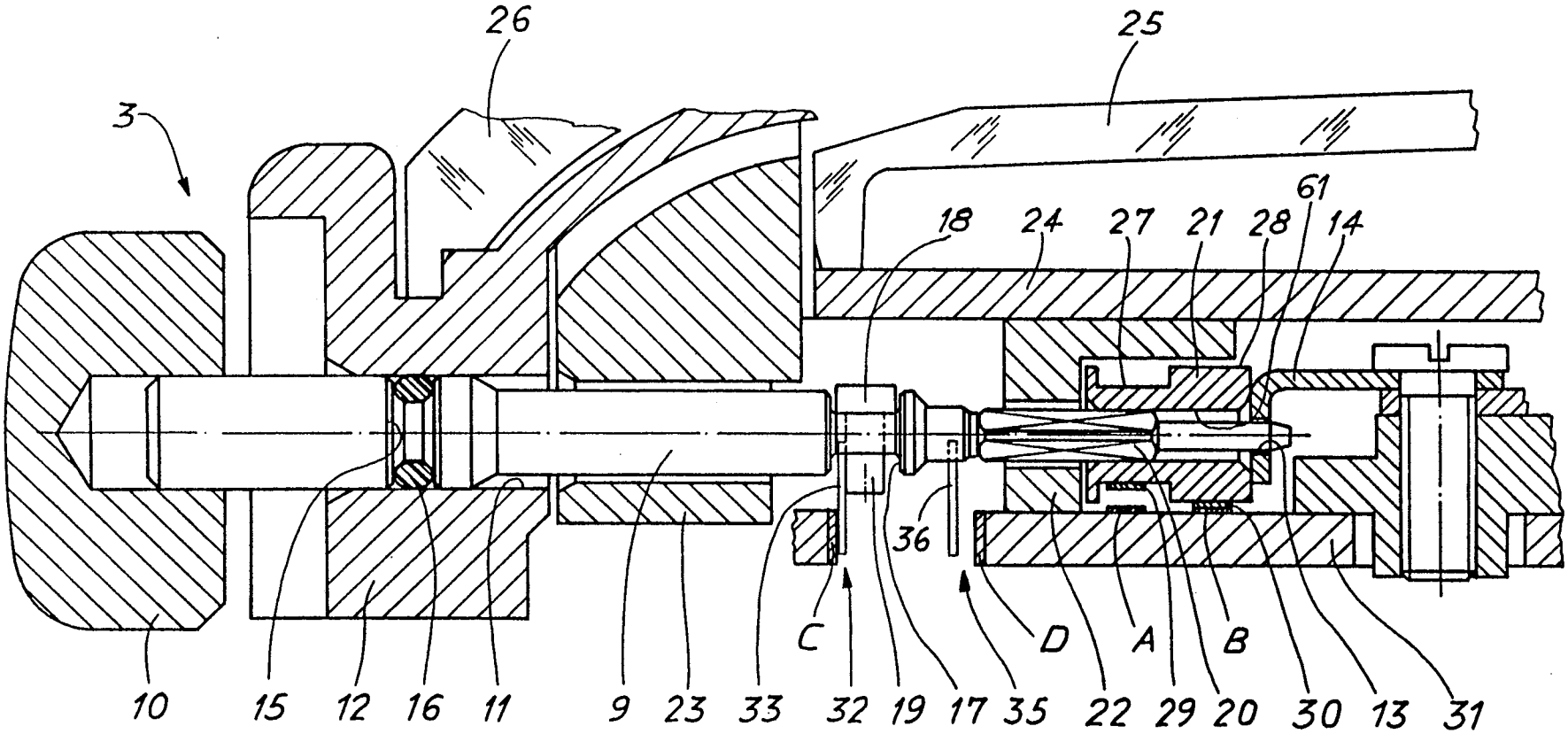
FIG. 6 shows the stem-crown mechanism of the two embodiments of the pager watch, this in a first stable drawn-out position of the stem, such arrangement permitting control of the timepiece including the combination of a timekeeper and of a pager.

The first position is a stable position shown on FIG. 6, in which position the timekeeper can be set by rotation of the crown. The second position, also a stable position, is shown on FIG. 7. This position is without any effect on the pager watch when one turns the crown. Finally, the third position illustrated on FIG. 8 is unstable and enables deleting the message by exerting an action in the longitudinal direction of the stem.

Figure 7:
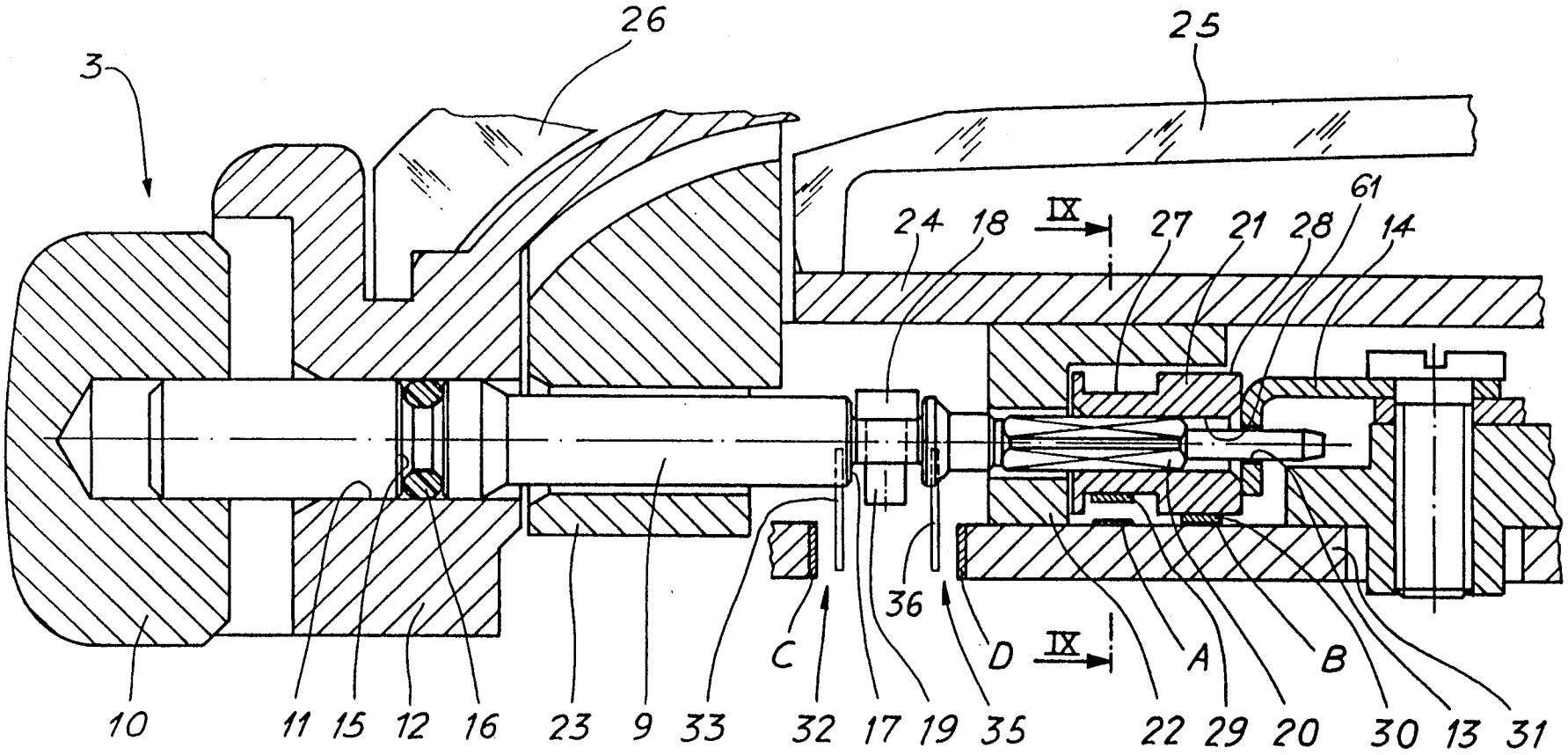
FIG. 7 shows the same mechanism in a second stable neutral position of the stem.
Figure 8:
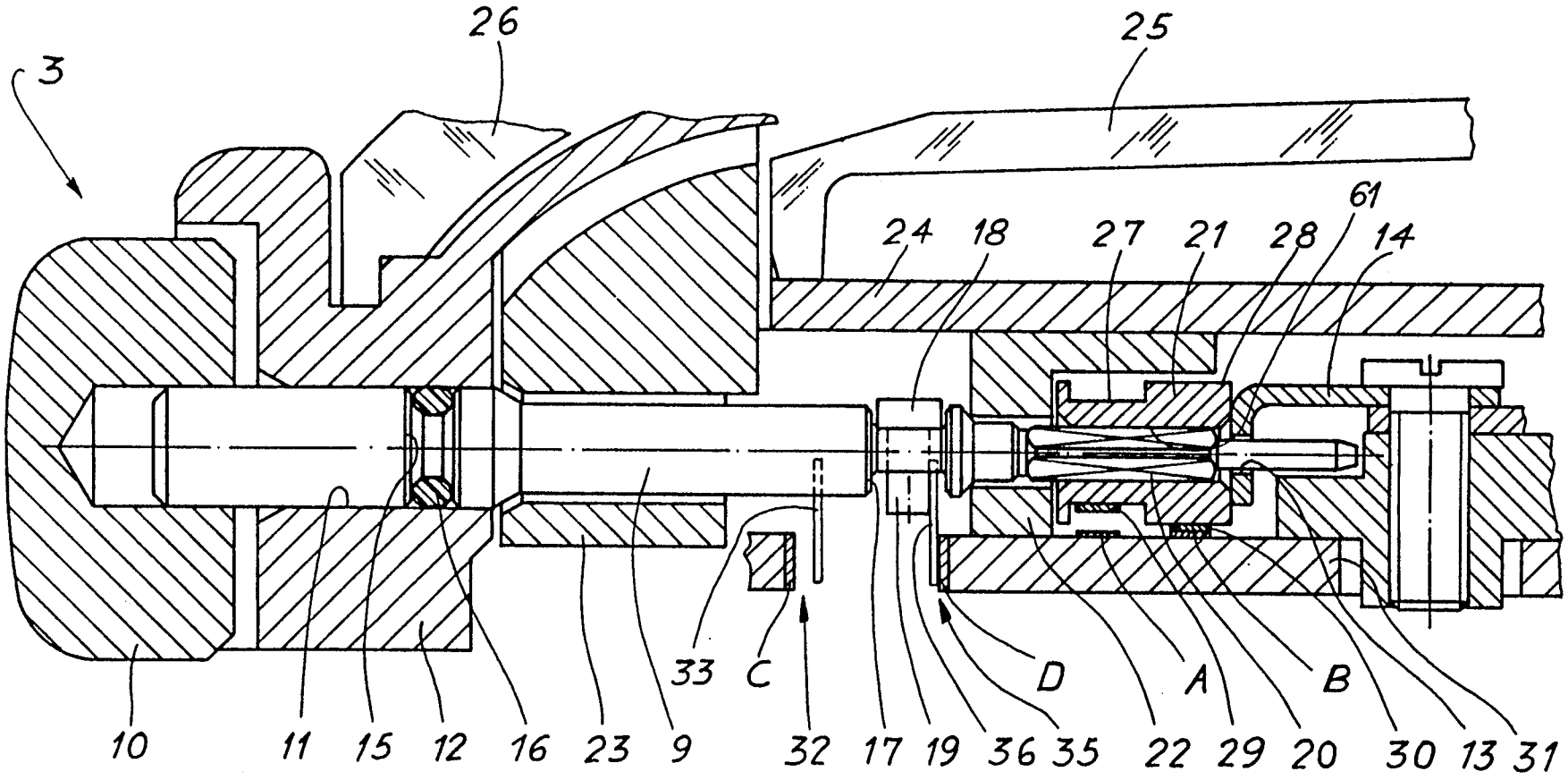
FIG. 8 shows the same mechanism in a third unstable pushed-in position of the stem.

The stem-crown 3 of FIGS. 6 to 8 includes an actual stem 9 fitted at its end with a crown 10 on which may be exerted a rotational motion or a pressure. Stem 9 slides in an opening 11 formed in the caseband 12 of the case and in a hole 13 formed in an elbowed element 14. The stem includes a groove 15 in which a packing 16 may be placed. The stem further includes another groove 17 in which is fitted a lever 18 fixed to a stud 19. Finally, the stem comprises a squared portion 20 adapted to slide in a sliding pinion 21 axially held in place by the elbowed element 14 and by another fixed elbowed element 22. There will be further recognized on FIGS. 6 to 8 elements described in the patent document EP-A-0 460 526 already cited, namely the baseplate 23, dial 24, first crystal 25 and second crystal 26.

Figure 10:
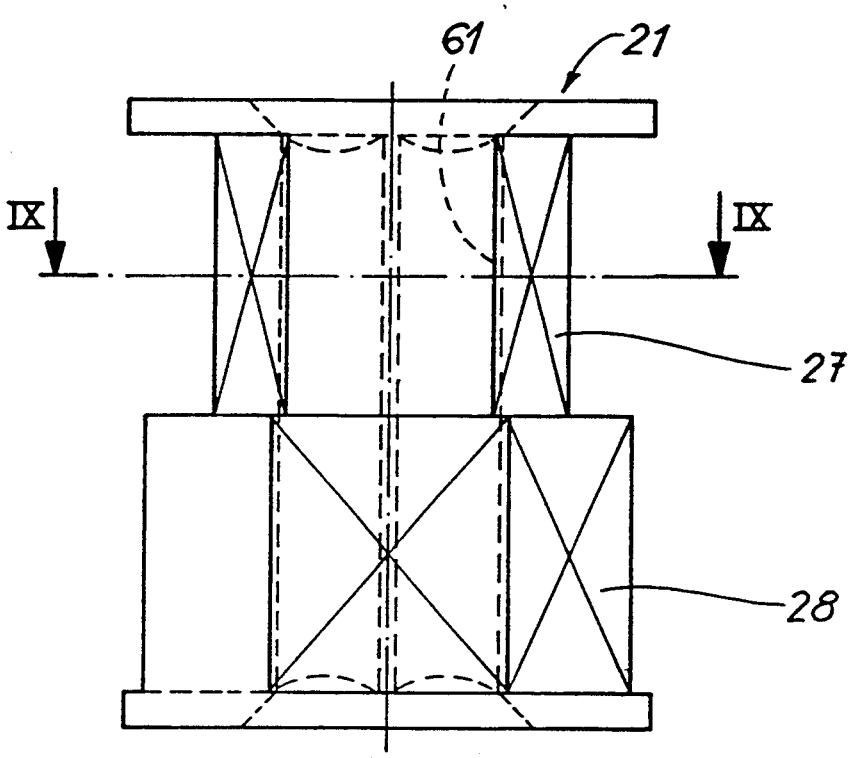
FIG. 10 is a view of the sliding pinion according to arrow X of FIG. 9.
Figure 9:
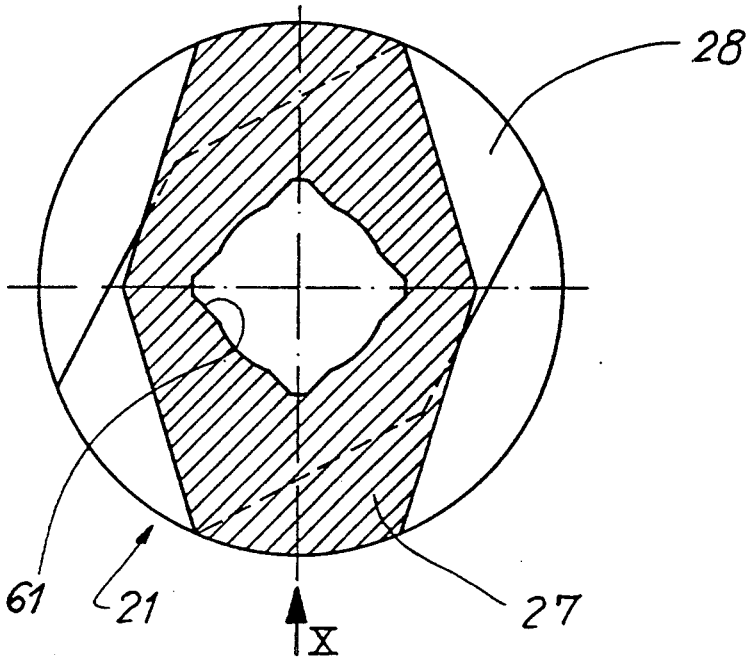
FIG. 9 is a cross-section along line IX—IX of FIG. 7 of the sliding pinion working with the stem.
Figure 11:
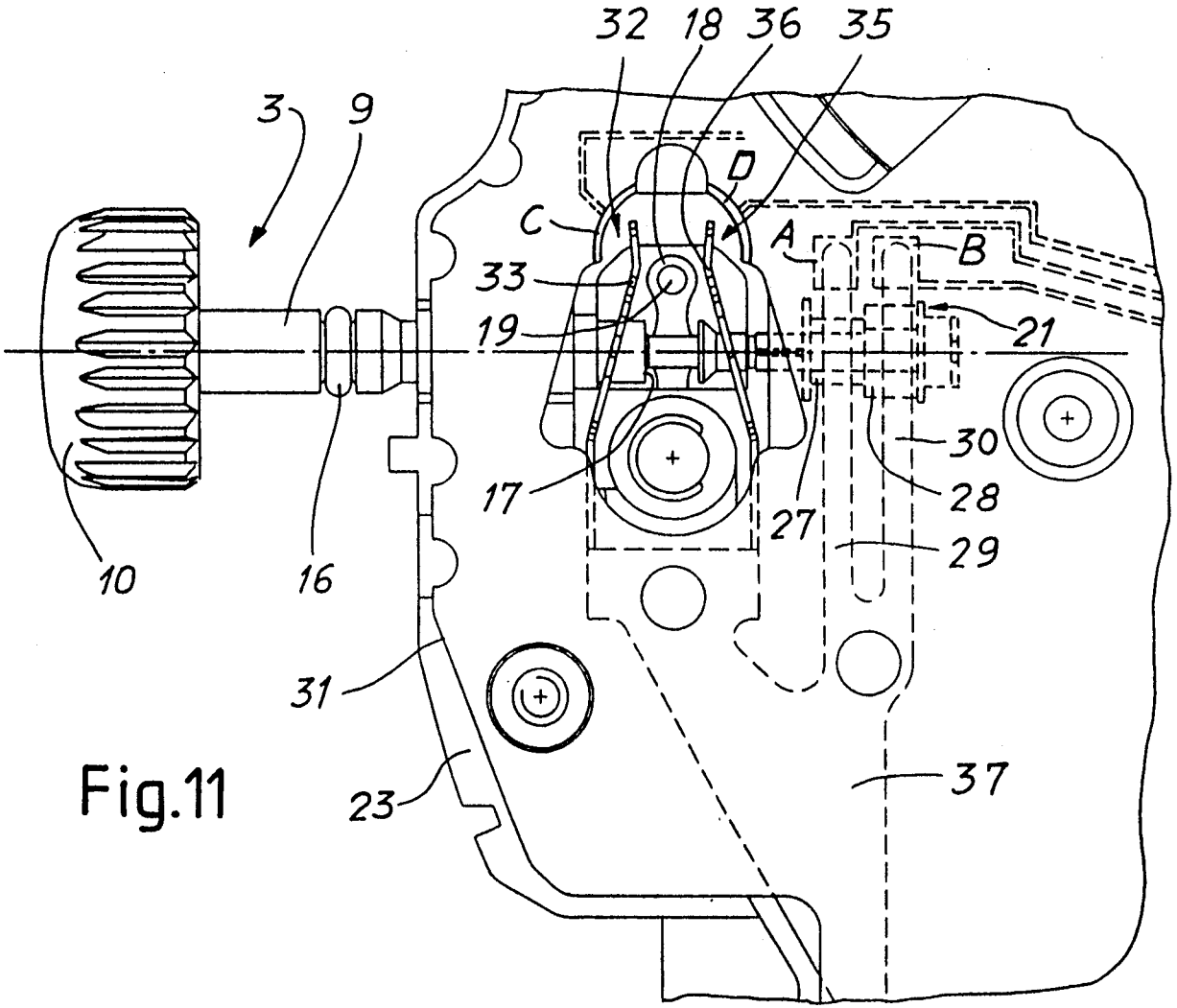
FIG. 11 is a plan view of the mechanism shown on FIG. 6.

The sliding pinion 21 is shown in detail on FIGS. 9 and 10. As is seen on FIG. 10, it includes two steps 27 and 28 and a hole 61 intended to accommodate the squared portion 10 of stem 9. Each of the steps includes an oblong section as is readily seen on FIG. 9 on the hatched portion of step 27. The steps 27 and 28 are angularly shifted relative to one another by about 45°. As is seen on FIG. 7 and on FIG. 11, which is a plan view from below of FIG. 7, elastic conductive blades 29 and 30 bear respectively on steps 27 and 28 of the sliding pinion 21 in a manner such that when the sliding pinion is driven in rotation by the stem, such blades 29 and 30 come alternately into contact with conductive tracks respectively designated by A and B, such tracks being engraved on a printed circuit 31. FIGS. 6 to 8 show that whatever be the axial position of the stem, the sliding pinion 21 remaining in place, blade 29 always contacts track A and blade 30 track B, such contacts taking place alternately as already said.

FIGS. 6 to 8 and FIG. 11 further show that the stem mechanism includes two other switches. A first switch 32 is formed by a conductive blade 33 capable of coming into contact with a conductive track C formed on the printed circuit 31. A second switch 35 is formed by a conductive blade 36 capable of coming into contact with a conductive track D also formed on the printed circuit 31. When they are driven by stud 19, blades 33 and 36 come into contact with tracks C and D respectively, stud 19 being driven in turn by the lever 18 cooperating with groove 17 of stem 9 as is apparent on FIGS. 6 and 8.

FIG. 6 shows the first drawn-out stable position of the stem-crown. This is the position for time setting the timekeeper whatever be the embodiment (according to FIG. 3 or according to FIG. 17). Here the first switch 32 is closed and if crown 10 is rotated, the first 29 and second 30 conductive blades are alternately driven to come into contact with the first A and second B respective conductive tracks. Rotation of the crown at an angular velocity less than a predetermined velocity enables step-by-step correction, in addition or in subtraction, of the minutes indication according to the rotation sense of the crown, while a rotation of the crown at an angular velocity greater than said predetermined velocity enables rapid correction in addition or in subtraction, of the hours indication by entire time zones according to the rotation sense of the crown. The means employed for such corrections are described in detail in the patent document CH-A-643 427 (U.S. Pat. No. 4,398,831), such means being taken up in both embodiments of the present invention. It may be added that in this first stable position, the correction of the time zone takes as reference the real time which runs from the actuation of the crown in the drawn-out position, means being employed to cancel all step-by-step minutes correction which- could have preceded correction of the time zone, as is set forth in patent document EP-B-0 175 961 (U.S. Pat. No. 4,620,797). The documents here cited take as base a watch movement having only a single motor with a motion work coupling the hours and minutes. In the present invention, it is foreseen to provide each of the hands with a motor having two rotation senses. For the person skilled in the art however, there will be no difficulties to apply the teaching of the cited documents to a movement including two independent motors.

FIG. 7 shows the second stable and neutral position of the stem-crown. This is a neutral position for which rotation of the crown has no effect. In this position the first 32 and second 35 switches are open, whilst rotation of the stem drives the first 29 and second 30 blades which come alternately into contact with respectively the first A and second B conductive tracks.

FIG. 8 shows the unstable pushed-in third position of the stem-crown. This is the position for which the displayed message can at least be deleted from the memory when one presses on the crown. In such position, the second switch 35 is closed.

If reference is once again had to FIG. 11, it will be noted that blades 29, 30, 33 and 36 constitute one and the same element having a common base 37. Such blades are cut out from a metal sheet, then folded over at 90° as far as concerns blades 33 and 36. The four blades thus are connected to a common electrical potential, namely Vpp as will appear in the schematic of FIG. 13.

Figure 12:
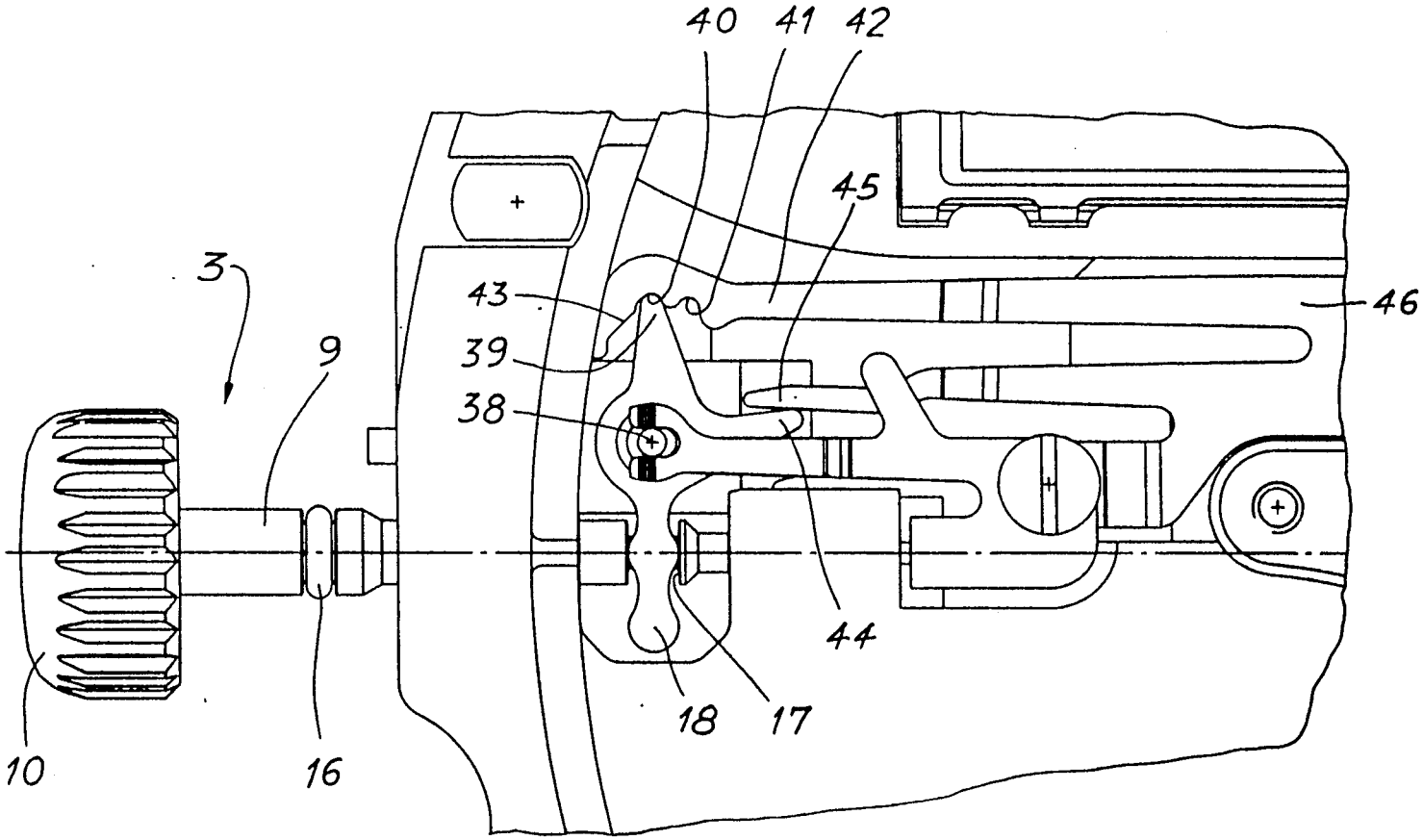
FIG. 12 is a view from below of FIG. 11 in which appears the stem latching system.

FIG. 12, which is a view from below of FIG. 6, shows that lever 18, driven by groove 17 of stem 9, pivots around a retaining axle 38. The lever is extended by a first nose 39 which cooperates with two notches 40 and 41 formed in a first elastic element 42. The stem of FIG. 12 is shown in the second neutral position where nose 39 is latched into notch 40. In pulling on the stem in order to bring it to the first drawn-out position, nose 39 will go over to be latched into notch 41. On the other hand, by pressing on stem 9 from the position which it occupies on FIG. 12, nose 39 climbs up a ramp 43 as exhibited by the first elastic element 42 which ramp has a tendency to bring the stem back into the neutral position when the pressure is interrupted. In order to increase further the return movement of the stem, the lever 18 has been given a second nose 44 which cooperates with a second elastic element 45, both elastic elements being formed from a single piece 46.

The same stem-crown which has just been described will be used in both embodiments of the pager watch according to the invention, which embodiments will now be described in detail. In summary, it has been seen that the operation of the stem is the same for both embodiments under consideration as far as concerns a) the time-setting function of the watch, b) the neutral function and c) the function deleting the message. For point c), the stem will show different functions according to whether it is used in one or the other of the embodiments under consideration.

1) First Embodiment

FIG. 3 is a plan view of the first embodiment of the pager watch according to the invention. In this embodiment, the pager watch includes, beside the stem-crown described in detail hereinabove, two supplementary pushpieces 1 and 2. The first push-piece 1 located at 8 o'clock enables the turning on and turning off of the pager. The second push-piece 2 located at 10 o'clock enables placing the pager in a standby state, for which the messages as received are at least stored in the memory without being signalled by the acoustic alarm 8, nor shown by hands 4 and 5.

It has already been said, the pager watch of the invention has two independent motors for the indication of hours and minutes with the purpose of bringing both hands into superposition in order to show the calling number inscribed on the bezel or the dial. Such a mechanism is described in patent document EP-A-0 393 605 (=U.S. Pat. No. 4,969, 133) and the reader will be able to refer thereto should further design details be wished for. How, from such a mechanism, it is possible to indicate time and also to employ the same hands in order to bring them into juxtaposition elsewhere than at noon, is described in patent document EP-A-0 476 425. This latter document concerns an analog timepiece in which the hands are in a predetermined position, for example superposed at 12 o'clock in order to mark a predetermined temporal reference, for example noon, such timepiece comprising an adjustment means in order to modify the position relative to the dial of the temporal reference, such new position for example being 6 o'clock.

Figure 13:
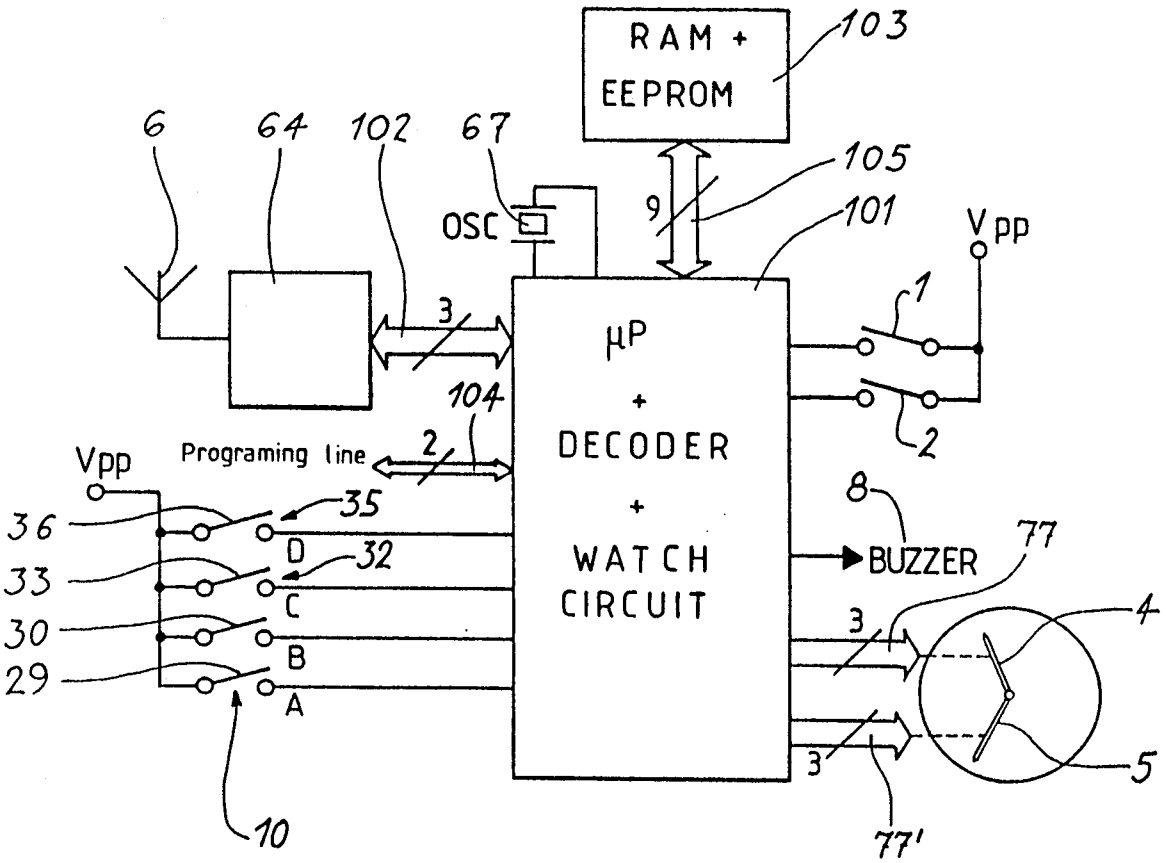
FIG. 13 is a block schematic showing the electronic part of the pager watch of FIG. 3.

FIG. 13 is a block schematic showing the electronic part of the pager watch illustrated on FIG. 3. Messages captured by antenna 6 are received by an RF circuit 64 (for example of the type UAA 2033 of the Philips Company) which is coupled to a dedicated circuit 101 by a three-wire bus 102. The dedicated circuit 101 unites an ordinary microprocessor with a decoder in order to decode the messages present at the output of RF circuit 64 (for example of the type PCF 5001 of the Philips Company). Such dedicated circuit further includes a watch circuit (for example of the type H 5026 from the company EM Microelectronic Marin SA) including a clock oscillator 67, a frequency divider, a first driver attacking, via a three-wire bus 77, a stepping motor having two rotation senses driving the hours hand 4 and a second driver attacking, by a three-wire bus 77', a stepping motor with two rotation senses driving the minutes hand 5. The decoder is associated with an EEPROM external memory 103 which can be programmed by the two wire programming line 104 in order to signal only messages intended for this specific pager having its own radio identification code (RIC) and answering in the circumstances to a radio-electric calling code, for example that bearing the number 1 of the CCIR (based on the recommendation CCIR 584-1, Dubrovnik, 1986). The dedicated circuit 101 is coupled by a nine-wire bus 105 to the EEPROM memory already cited, such memory being associated with another memory RAM. An acoustic warning device or buzzer 8 is coupled to the dedicated circuit 101.

To circuit 101 are connected conductive tracks A and B to which correspond respectively the conductive blades 29 and 30 and the conductive tracks C and D to which correspond respectively the conductive blades 33 and 36 forming respectively switches 32 and 35, such tracks and blades having been described hereinabove and discussed in connection with FIGS. 6 to 12. Blades 29, 30, 33 and 36 are all connected to a common potential Vpp. The fact that the crown be rotated has as effect that tracks A and B are alternately coupled to potential Vpp. Such alternation is taken into account by circuit 1 01 which is then capable of knowing initially the fact that the crown is driven in rotation and next in which sense such rotation takes place.

The RAM memory 103 of FIG. 13 is of known construction. In such RAM memory, messages are stacked one onto the other. The RAM memory being able to contain only a limited number of messages, it is evident that if said memory is full, a new entering message repeating itself for the second time will bring about loss of the oldest identical message.

FIG. 13 further shows that to .dedicated circuit 101 are coupled push-pieces 1 and 2 coupled on the other hand to the same potential Vpp.

With the help of FIGS. 14 to 16, there will now be described the manner of using the pager watch in acting on the one hand on crown 10 and on the other hand on pushpieces 1 and 2. The symbols employed on the figures in question with their significance are the following:

>1 : Press on push-piece 1.

>2: Press on push-piece 2

<10: Press on crown 10

Figure 14:
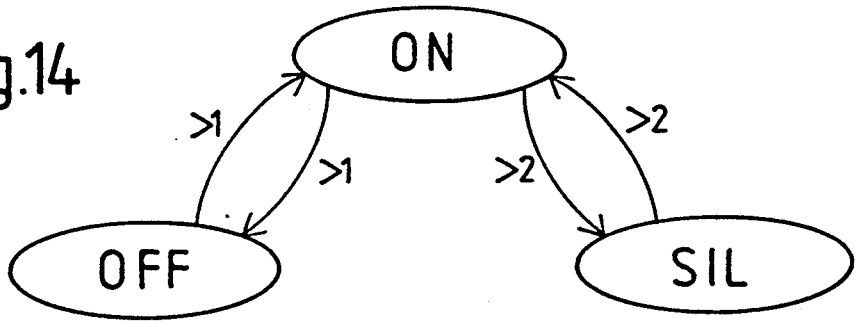
FIG. 14 is a diagram explaining the functions of push-pieces 1 and 2 with which the pager watch of FIG. 3 is furnished.

FIG. 14 explains the functions of push-pieces 1 and 2. If the pager has a turned-on status (ON) and push-piece 1 is pressed (>1), said pager is turned off, such operation being accompanied by a long bip emitted by the acoustic transducer. Inversely, if the pager is in the turned-off status and push-piece 1 is pressed (>1), said pager is turned on, such operation being likewise accompanied by a long bip. FIG. 14 further shows that if the pager is turned on and only from such state (ON) and if push-piece 2 (>2) is pressed, the pager is placed in the standby or silent state (SIL) for which entering messages are only stored in the memory. From the standby state SIL one can return to the turn-on state (ON) by pressing on push-piece 2 (>2). Here likewise the passage from ON to SIL and vice-versa brings about the triggering of a long bip by the transducer. Finally, in order to know in what state the pager is, crown 10 may be pressed and there will be recovered 1, 2 or. 3 short bips according to whether the pager is respectively in the ON, OFF or SIL state.

Figure 15:
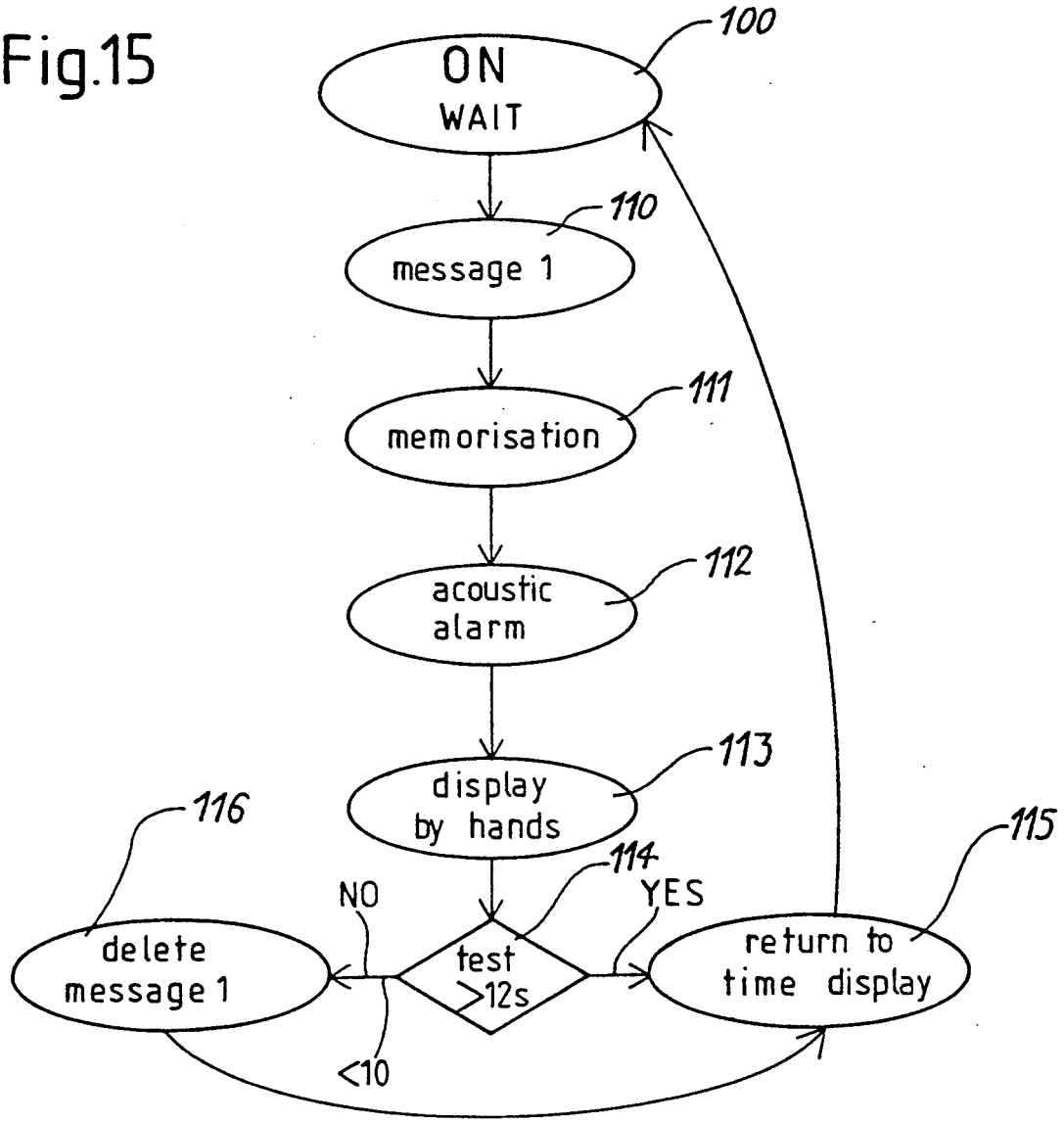

FIG. 15 is a diagram explaining how a message is received by the watch when the pager is turned on. For this it is initially in the ON state and thus in waiting 100. There then arrives a message 110 detected as corresponding to one of the RIC of the receiver. This message is memorized at 111 and triggers an acoustic alarm at 112. Hands 4 and 5 cease their time display function and come to show the calling number (or its code) of the caller at 113. The display 113 and alarm 112 will continue during a predetermined time lapse, for example 12 seconds. A test center 114 evaluates as to whether the signal has lasted more than 12 seconds (>12s). If yes, the hands return to the time display 115, the message is maintained in the memory and the receiver returns to the.waiting state 100 for a new message. If no, the message is deleted from the memory at 116, the hands return to displaying time at 115 and the receiver returns into the waiting state 100 for a new message. Interruption of the signal before 12 seconds have run out is brought about in placing crown 10 (<10) in its third unstable position (FIGS. 8 and 13, switch 35 closed by the contact of blade 36 with track D).

Figure 16:
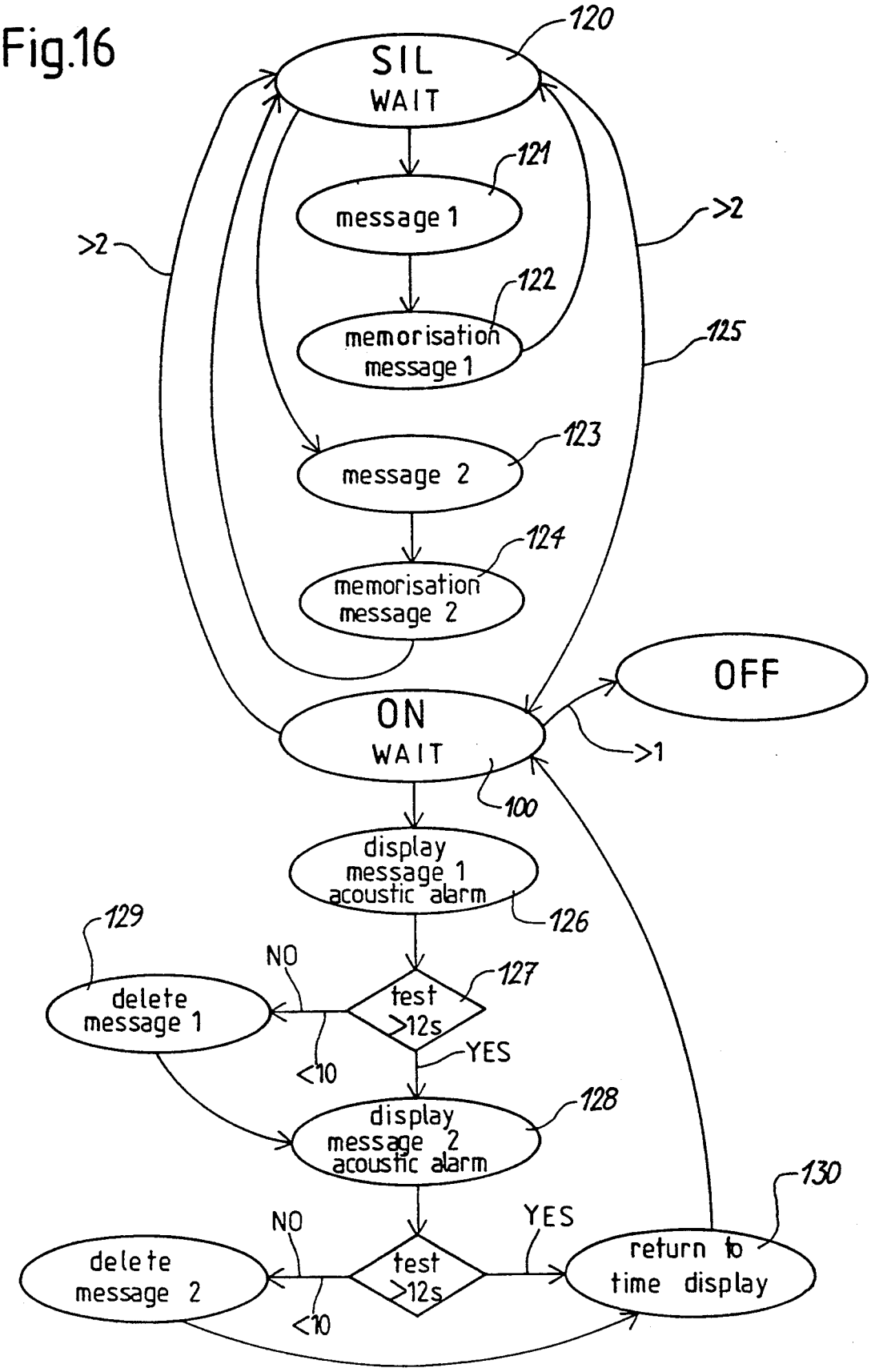
FIG. 16 is a diagram explaining how at least two messages are received in the pager watch of FIG. 3 when the receiver is in the standby or silent mode.

FIG. 16 is a diagram explaining how two messages 1 and 2 are received by the watch when the pager is in standby or silent mode. For this, it is initially in state SIL 120 and thus standby. If a first message 121 arrives, it is memorized at 122 with neither display nor alarm. The pager then returns to the standby state SIL 120. If a second message 123 arrives, the same cycle repeats: memorization 124, then stand-by state SIL 120.

If the watch wearer now wishes to know the calls received during the standby period, he presses push-piece 2 (>2, reference 125) in order to place the pager in the waiting state ON 100. If messages have been memorized, the pager begins by restoring the first message 121 which is acoustically announced and displayed by superposition of the hours and minutes hands 4 and 5 (reference 126). As has been explained with reference to FIG. 15, a test center 127 evaluates whether the signal has lasted more than 12 seconds (>12s). If yes, the message is maintained in the memory and the display of the second message 123 is acoustically announced and displayed by the hands (reference 128). If no (pressure on crown 10 [<10] before expiry of the time lapse 12 seconds), announcing and display 128 of the second message take place, but with deletion (reference 129) of the first message. An identical cycle is repeated then for the second message with or without deletion according to whether crown 10 has been pressed or not prior to the running out of the time lapse of 12 seconds. Once all the messages have been brought out, the hands return to their time display function (reference 130) and the receiver goes into waiting for new messages (100) unless it is turned off (OFF) by pressing on push- piece 1 (<1).

2) Second Embodiment

Figure 17:
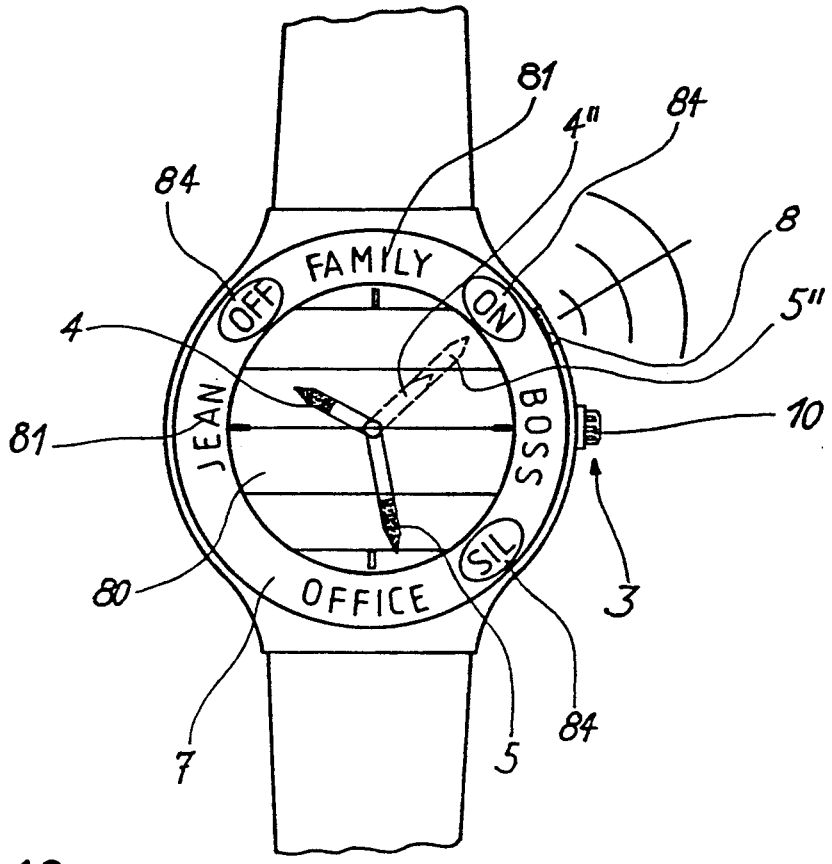
FIG. 17 is a plan view of the pager watch obtained according to a second embodiment of the invention.

FIG. 17 is a plan view of the second embodiment of the pager watch according to the invention. Compared with the first embodiment, such second embodiment includes only a stem-crown 3 excluding any other push-piece. Here the functions ON-OFF and ON-SIL described hereinabove are fulfilled by the stem-crown 3.

In this embodiment stem-crown 3 is capable of turning on, turning off and placing the receiver in a standby state and the turn-off (OFF), turn-on (ON) and standby (SIL) states are inscribed at 84 on bezel 7 of the watch. Hands 4 and 5, in addition to their time display function, can here display not only the calling numbers 81 as discussed hereinabove, but further the status of the pager, for example in superposing themselves at 4'', 5'' on the indication ON, indicating thereby that the pager is turned on.

The electronic portion of the pager watch according to this second embodiment differs from that shown on FIG. 13 only through the absence of push-pieces 1 and 2 coupled to the dedicated circuit 101. It has thus not been judged necessary to show such a schematic by a new drawing. In this second embodiment, only a special arrangement of the microprocessor comprised in circuit 101 enables passing from the first to the second embodiment, which arrangement enables taking into account the time duration over which crown 10 can be pressed into the third unstable position.

With the help of FIGS. 15, 18 and 19, there will now be described the manner of using the pager watch in acting on the single crown 10. The symbols employed on the figures in question with their significance are as follows:

<10 : short pressing on crown 10

<<10 : long pressing on crown 10.

Figure 18:
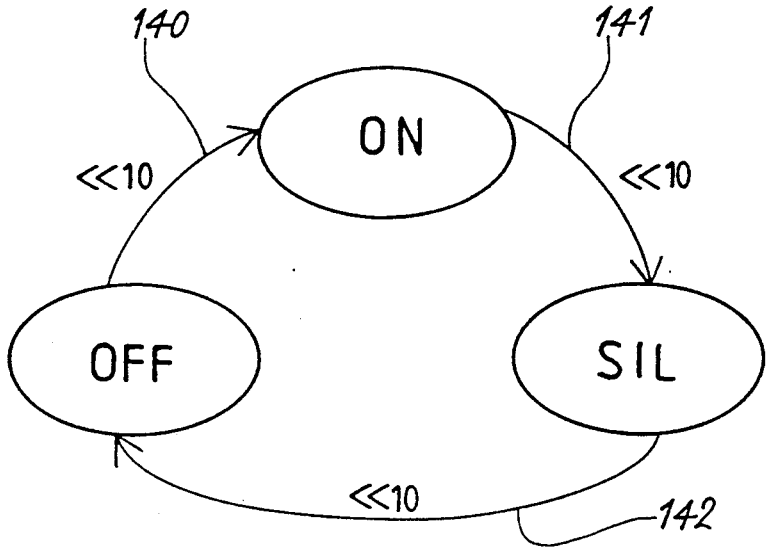
FIG. 18 is a diagram showing how the crown of the pager watch of FIG. 17 is acted upon in order to call up the various states in which said watch may be placed.

As is apparent on FIG. 18, in bringing the stem into its third unstable position (FIG. 8) by a first pressure <<10, reference 140, during a period greater than a predetermined period, for example 2 seconds, one goes from the turned-off state OFF to the turned-on state ON; by a like second pressure <<10, reference 141, from the turned-on state ON to the standby state SIL; and by a third like pressure <<10 reference 142 from the standby state to the turned-off state and thus continuing the cycle.

As shown by FIG. 15, if the receiver is in the turned-on state ON 100, the indication of the entering message 110 shown by the ,hands at 113 is accompanied by an acoustic signal at 112 during a predetermined time lapse, for example 12 seconds, after which the hands return to their time indicating position at 115, the message remaining recorded in the memory. If, before the time lapse of 12 seconds has run out, the crown 10 is pressed during a period less than said predetermined period defined in the above paragraph <10, the message is deleted from the memory at 116 and the hands return to the time display at 115. It is noted that this process is identical to that described with reference to the first embodiment of the invention, with the center of decision 114. One may refer back thereto if necessary.

Figure 19:
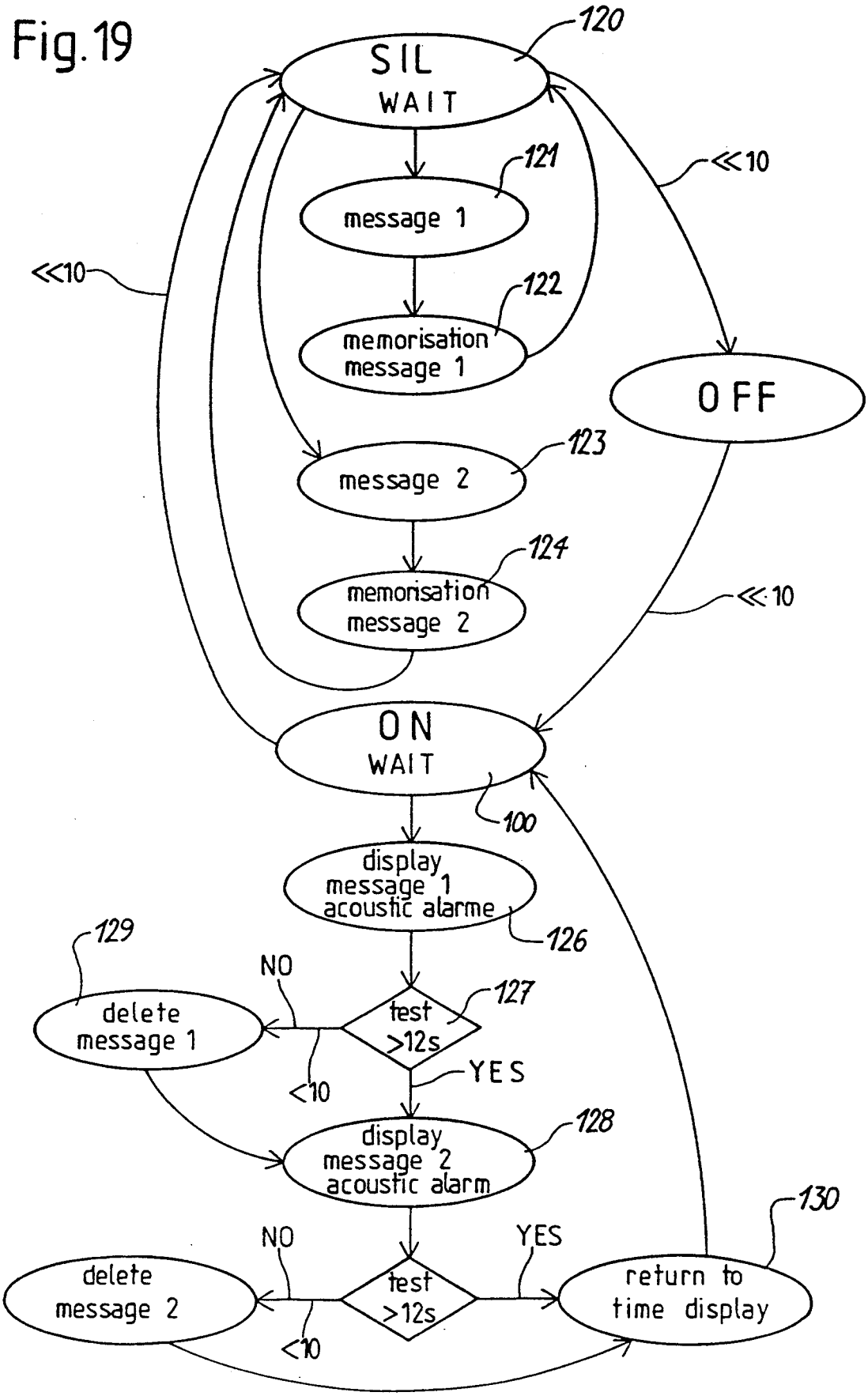
FIG. 19 is a diagram explaining how at least two messages of the pager watch of FIG. 17 are received when the receiver is in the silent mode.

FIG. 19 is a diagram explaining how two messages 1 and 2 are received when the pager is in the silent standby mode. This reception is the same as that explained with reference to FIG. 16. It will thus not be extended here. Should the watch wearer now wish to know the calls received during the standby period, he will pass from the mode SIL to the mode ON by pressing the crown twice during a period greater than the predetermined period of two seconds (2 × <<10) and this in passing through the OFF mode. The pager will then restore the memorized messages, as has been described with reference to FIG. 16.

It will be noted that the state in which the pager is may be inspected at any time. It is sufficient for this, when the pager indicates the time, to exert a short pressure (<10) on crown 10. Hands 4 and 5 will then in superposing themselves show one of the three inscriptions ON, OFF or SIL inscribed on bezel 7 (see FIG. 17).

Figure 20:
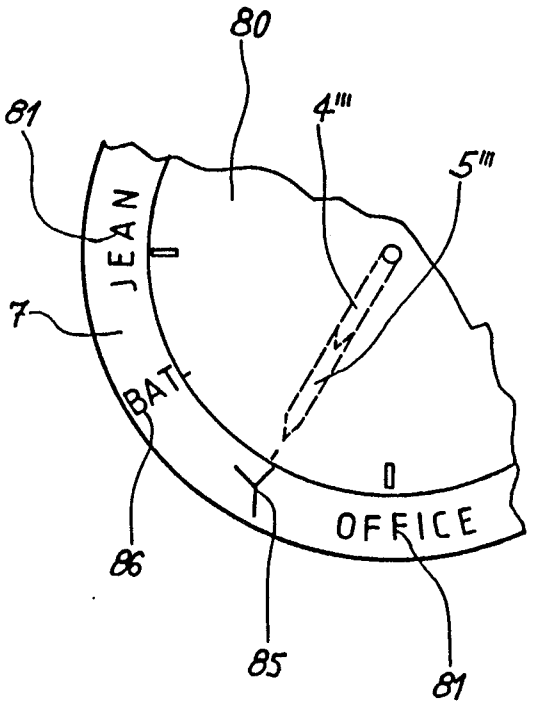
FIG. 20 shows a variant of the embodiment of the pager watch illustrated on FIG. 17.

FIG. 20 is a variant of the embodiment of the pager watch illustrated in FIG. 17. Here there has been shown at an enlarged scale the part of the watch located between 6 o'clock and 9 o'clock. In addition to the indications 81 and 84 borne by bezel 7, the watch of FIG. 20 bears the indication Y, referenced 85, and the indication BAT, referenced 86.

The watch "Swatch pager tone only" under discussion in the introduction to this description is equipped with a system warning the wearer that the battery energizing the receiver is exhausted. In the ON mode, as soon as the battery is below a limit voltage, a bip of a duration of 16 seconds sounds, which bip can be interrupted by pressing on crown 10. The wearer is thus warned that he must replace the battery in the next hours.

In the present invention, it is the hands which are going to indicate such state of exhaustion, which as soon as a lower voltage threshold is attained, come, by superposition, to show the indication BAT, referenced 86. This indication may be preceded by a short bip.

The bezel 7 of the watch of FIG. 20 also bears an indication Y referenced 85 which indication symbolizes the pager antenna. For the case in which the signal quality is insufficient, the hands will be brought to show indication Y in being superposed (references 4''' and 5''') thereover. This shows the wearer that he is located in a zone poorly covered by the transmitter broadcasting the messages and that it is desirable to move elsewhere.

The functions BAT and Y are possible thanks to a self-checking system of the pager which, for example every four minutes, tests whether the battery voltage and the reception quality are sufficient. In the negative, the pager displays such failings as explained hereinabove.

The invention is not limited to the display of the auxiliary functions BAT and Y. Other functions can exist, for example a function FULL which indicates that the memory is full and/or a function NEW which indicates that a new message has arrived. Such indications FULL and NEW are inscribed on the bezel or the dial and the hands show them when the situation occurs.

The description which has just been given is based on two embodiments given by way of example. It will be understood that other embodiments are possible without departing from the spirit of the present invention. For example, there can be imagined a stem-crown showing a stable position additional to the two stable positions as described, such additional position enabling, by turning the crown, to choose the functions ON, OFF or SIL and to display such functions by means of the hours-minutes hands of the watch. In such specific embodiment, however, the spirit of the invention remains the same, namely basically the display of the calling numbers by the hands serving to display time and subordinately the display of the status in which the pager happens to be.

What we claim is:

1. A timepiece including a time keeper in order to display at least hours and minutes by means of hands surmounting a dial surrounded by a bezel, a receiver capable of receiving radio broadcast messages for seeking persons, reception being triggered by the composition on a telephone handset of one of at least two predetermined and distinctive calling numbers, a memory for storing said calls, an acoustic transducer for signalling at least the arrival of a message and a control arrangement including at least one stem fitted into a crown adapted to be manually actuated, and wherein at least the calling numbers are inscribed on the dial or the bezel in plain language or in coded form, means being actuated so that at least upon reception of a message such is stored in the memory and at least one hand ceases its time indicating function in order to come to show the calling number emitting the message.

2. A timepiece as set forth in claim 1, wherein at least upon reception of a message both hours and minutes hands cease their hours and .minutes indicating functions in order to come to show the calling number emitting said message by superposing themselves thereover.

3. A timepiece as set forth in claim 1, wherein the calling numbers or their coded forms are affixed onto a moveable bezel, the inscriptions being carried out according to the wishes of the timepiece wearer.

4. A timepiece as set forth in claim 2, wherein the stem may be brought into at least three different axial positions, a first stable position in which the time keeper can be set to the time of day by rotation of the crown, a second stable position in which rotation of the crown has no effect and a third unstable position in which at least the received message can be deleted from the memory by action exerted in the longitudinal direction of the stem.

5. A timepiece as set forth in claim 1, wherein the first stable position is a drawn-out position arranged to close a first switch and for which rotation of the crown drives alternately first and second conductive blades which enter into contact with respective first and second conductive tracks, the second stable position is an intermediate position between the first and the third position, and that the third unstable position is a pushed-in position arranged to close a second switch when pressure is exerted on the crown.

6. A timepiece as set forth in claim 1, wherein the control arrangement includes in addition a first pushpiece capable of turning on or turning off the radio broadcast message receiver and a second pushpiece capable of placing said receiver in a standby state in which received messages are at least stored in the memory without being signalled by said transducer nor shown by said hands.

7. A timepiece as set forth in claim 4, wherein the control arrangement includes only a single stem fitted into a crown adapted to be manually actuated and capable of turning on, turning off or placing the receiver in a standby state in which received messages are at least stored in the memory without being signalled by said acoustic receiver nor shown by said hands, the states of turn-on, turn-off or standby being inscribed on the dial or the bezel, the hands being additionally capable of showing the current state of the receiver.

8. A timepiece as set forth in claim 6, wherein when the stem is brought into its first stable position, rotation of the crown at an angular velocity less than a predetermined velocity enables step-by-step correction in addition or subtraction of the minutes indication in accordance with the rotation sense of the crown, and rotation of the crown at an angular velocity greater than said predetermined velocity enables the rapid correction in addition and subtraction of the hours indication by entire time zones in accordance with the rotation sense of the crown.

9. A timepiece as set forth in claim 6, wherein if the receiver is in the turned-on state the indication of the entering message as shown by the hands is accompanied by an acoustic signal during a predetermined time lapse, following which the hands return to their time indicating position, said message remaining stored in the memory.

10. A timepiece as set forth in claim 9, wherein if the crown is pressed into its third unstable position before the end of said time lapse, said message is deleted from the memory and the hands return to their time indicating position.

11. A timepiece as set forth in claim 6, wherein if said timepiece is indicating time, the turn-on state, turn-off state or standby state of the receiver are signalled by an acoustic signal upon pressing the crown into its third unstable position, each of said states being indicated by a different acoustic signal.

12. A timepiece as set forth in claim 6, wherein in passing from the standby state into the turn-on state by pressing the second pushpiece, the hands indicate successively the messages which have been stored while the receiver was in the standby state.

13. A timepiece as set forth in claim 7, wherein in bringing the stem into its third unstable state by a first pressure on the crown during a period greater than a predetermined period, passage is effected from the turn-off state to the turn-on state, by a second pressure from the turn-on state to the standby state, by a third pressure from the standby state to the turn-off state and thus continuing the cycle.

14. A timepiece as set forth in claim 7, wherein if the receiver is in the turn-on state the indication of the entering message as shown by the hands is accompanied by an acoustic signal during a predetermined lapse of time, after which the hands return to their time indicating position, said message remaining stored in the memory.

15. A timepiece as set forth in claim 14, wherein if the crown is pressed into its third unstable position during a period less than said predetermined period before the end of said lapse of time, said message is deleted from the memory and the hands return to their time indicating position.

16. A timepiece as set forth in claim 13, wherein passage from the standby state to the turn-on state is effected by two successive pressures exerted on the crown, each during a period greater than said predetermined period, the hands indicating successively the messages which have been stored while the receiver was in the standby state.

17. A timepiece as set forth in claim 7, wherein if said timepiece is indicating time, the turn-on state, turn-off state or standby state of the receiver are indicated by the hands which, if a pressure is exerted on the crown during a period less than said predetermined period, are superposed onto the corresponding inscription affixed onto the bezel or the dial.

18. A timepiece as set forth in claim 7, wherein the dial or the bezel bear in addition a first indication relating to the voltage of the battery energizing the receiver and/or a second indication relating to the quality of the radioelectric signal received by the receiver and the hands show the first or the second indication according to whether the battery voltage or signal quality are insufficient.

19. A timepiece as set forth in claim 2 wherein the calling numbers or their coded forms are affixed onto a moveable bezel, the inscriptions being carried out according to the wishes of the timepiece wearer.

20. A timepiece as set forth in claim 7 wherein the stem is brought into its first stable position, rotation of the crown at an angular velocity less than a predetermined velocity enables step-by-step correction in addition or subtraction of the minutes indication in accordance with the rotation sense of the crown, and rotation of the crown at an angular velocity greater than said predetermined velocity enables the rapid correction in addition and subtraction of the hours indication by entire time zones in accordance with the rotation sense of the crown.

* * * * *